US006030302A

United States Patent [19]

Chojnacki

[11] Patent Number: 6,030,302

[45] Date of Patent: Feb. 29, 2000

[54] GAMES RACKETS

[75] Inventor: Robert Marek Chojnacki, London, United Kingdom

[73] Assignee: Dunlop Slazenger Group Limited, Camberly, United Kingdom

[21] Appl. No.: 09/135,887

[22] Filed: Aug. 18, 1998

[30] Foreign Application Priority Data

Aug. 22, 1997 [GB] United Kingdom ..... 9717720

[51] Int. Cl.[7] ..... A63B 49/08

[52] U.S. Cl. ..... 473/531; 473/552

[58] Field of Search ..... 473/552, 551, 473/531, 549, 300, 307

[56] References Cited

U.S. PATENT DOCUMENTS

| | | | |
|---|---|---|---|
| 2,576,751 | 11/1951 | Dortmund | 473/551 X |
| 4,205,844 | 6/1980 | Gombas . | |
| 4,671,511 | 6/1987 | Trysinsky . | |
| 4,693,475 | 9/1987 | Keilhau . | |
| 4,953,862 | 9/1990 | Uke . | |
| 5,169,145 | 12/1992 | Jang . | |
| 5,599,019 | 2/1997 | Davis et al. | 473/549 |

FOREIGN PATENT DOCUMENTS

| | | | |
|---|---|---|---|
| 0 579 880 A1 | 1/1994 | European Pat. Off. . | |
| 0 760 245 A1 | 3/1997 | European Pat. Off. . | |
| 2540388 | 8/1984 | France . | |
| 1112435 | 8/1961 | Germany | 473/FOR 173 |
| 0149106 | 12/1984 | Germany . | |
| 3521621 | 1/1986 | Germany | 473/FOR 183 |
| 3941411 | 8/1990 | Germany | 473/FOR 183 |
| 2149311 | 6/1985 | United Kingdom | 473/FOR 183 |
| 2230458 | 10/1990 | United Kingdom . | |
| WO81/03431A1 | 12/1981 | WIPO . | |

*Primary Examiner*—Raleigh W. Chiu
*Attorney, Agent, or Firm*—Lorusso & Loud

[57] ABSTRACT

The games racket comprises a head (1) and a shaft (2), the shaft being fitted with a separable extension module (8) bearing a hand grip. The two components (2, 8) are locked rigidly together by a wedging action. Preferably the shaft (2) is provided at its free end with legs (4, 5) defining a slot (6) which has wedge profiles (7) formed in it. The extension module (8) is push fitted over the legs (4, 5) and a locking device (12, 13) is inserted into the slot (6), the locking device having a wedging element (13) which bears against the wedge profiles (7). Various extension modules (8) can be stocked at the point of sale of the racket in order to provide rackets of differing lengths and/or grip sizes.

9 Claims, 1 Drawing Sheet

GAMES RACKETS

This invention relates to games rackets, particularly tennis rackets.

Tennis rackets are now made from advanced composite materials and these together with modern manufacturing techniques allow them to be made much lighter than hitherto. This has allowed both head size and overall length to be increased to the ultimate within limits set by the controlling authority (The International Tennis Federation) which was not previously possible at acceptable overall racket weight.

While the head size of a racket is established at the manufacturing stage, its overall length can be changed subsequent to manufacture if certain design criteria are met and this is the objective of this proposal.

The object of the present invention is to allow the overall length of the racket to be chosen by the player at the point of sale by providing a means by which the length of a racket can be extended by the fitment of a special 'extension module' (incorporating the grip of the racket), the length of which can be chosen from a group of such modules. In addition, the extension modules from which a selection is made may also incorporate grips of varying diameters so that both racket length and grip size may be chosen at the point of sale. Not only is this facility convenient to the player purchasing a racket but it also reduces the inventory of rackets required at the point of sale.

According to the present invention a games racket comprises a head and a shaft wherein the shaft consists of two separable components locked rigidly by a wedging action prior to the use of the games racket, the separable components consisting of shaft portions integral with the head and an extension module.

Essentially then, it is proposed that special racket frames and associated extension modules are designed with features which allow the frame and module to be easily assembled together in a manner such that they are rigidly and securely joined together but such that, if required, the overall racket length and/or grip size can be changed by the substitution of another module. If desired the extension module length can be selected so that the resulting games racket length is greater than the norm i e 27" or more. The extension module may actually constitute the gripping area of the racket or could constitute the gripping area and part of the shaft. A further variation can be introduced in the form of weights attached to the head of the racket. These would modify the moment of inertia and/or the swing weight of the racket about the extreme end of the extension module.

A racket frame consists essentially of an integral head, 'heart' and shaft where the heart is the area between the head and the shaft. In a normal racket, the grip is at the lower part of the shaft and usually consists of a spiral wrapping of leather or similar material around the shaft which may incorporate an 'undergrip' to provide appropriate cross-sectional shape and size to the gripping surface.

A preferred embodiment of the present invention will now be described with reference to FIGS. 1, 2 and 3 in which.

Figure 1:
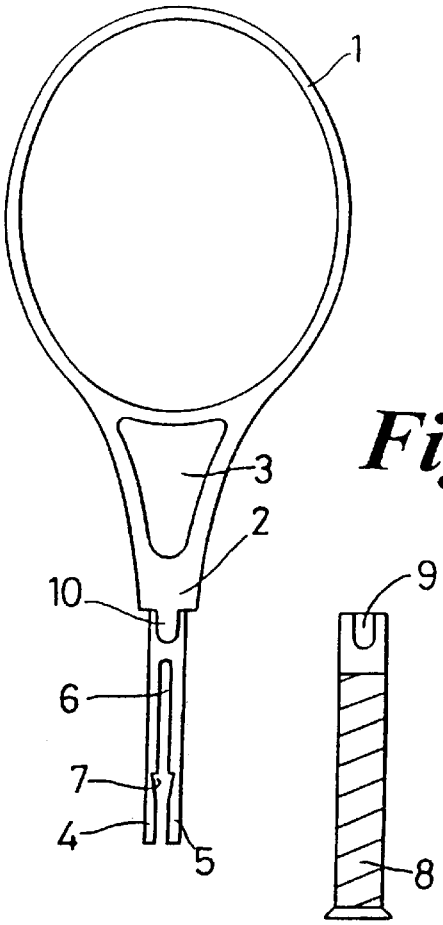
FIG. 1 is a view of the games racket before assembly with a wedging means (not shown)
Figure 2:
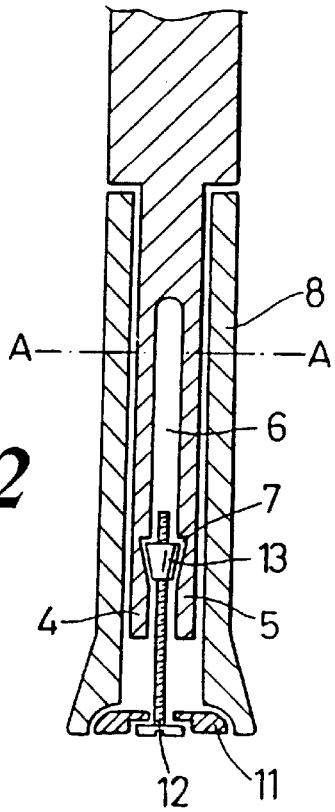
FIG. 2 is a longitudinal cross-section of the games racket of FIG. 1 assembled with wedging means.

Referring to FIGS. 1 and 2 the shaft 2 of the racket is reduced in cross-section so that the tubular extension module 8 may be fitted by sliding it into position over the shaft, if required the module being of such a length so that the effective length of the racket is increased over the conventional length. Certain special design features are required in both the racket shaft and extension module to allow firm and rigid assembly to be easily and quickly carried out.

Preferably the extension module 8 is a 'push fit' onto the racket shaft. Also the cross-sectional shape of the shaft and that of the extension module are preferably of non-circular shape, more preferably in the shape of a regular or irregular polygon—for instance an octagon. Such a shape prevents any torsional movement of the module on the shaft and it is in any case a desirable shape for underlying the grip of the module. The legs 4,5 of the shaft 2 define a slot 6 with wedge profiles 7.

In the embodiment shown, a slot 9 at the upper end of the extension module is made to engage a tongue 10 on the outer surface of the racket frame adjacent to the heart area 3 so that positive location and keying of the two components 2,8 takes place when the module 8 is pushed into position.

A special locking device is incorporated in the lower shaft area of the frame and at a corresponding point on the module such that the two components can be firmly locked together. This feature will now be described in conjunction with FIG. 2.

The lower shaft 2 of the racket frame is made in the form of two 'legs' 4,5 which can be expanded against the inner surface of the module by the movement of a wedging element 13 against wedge profiles 7 on the inside of the legs 4,5 of the shaft by actuating a screwing mechanism. Rotation of screw 12 causes wedge element 13 to move down between wedge profiles 7 so expanding the legs 4,5 against the inside of the extension module. At the same time the reaction of the head of the screw against the outer end 11 of the module causes the module to be thrust upwards so that the tongue 10 and slot 9 device become keyed together. The outer end 11 need not be separate from extension module 8 but could be integral therewith.

As a special additional feature, the inner profile of the module 8 may incorporate a 'draw' so that it tapers inwardly from its lower end towards its upper end, where the upper end is that end adjacent to the heart of the racket. An appropriate draw is 2°. The legs 4,5 of the shaft will therefore be expanded to a degree beyond a parallel alignment such that the module is even further securely locked in position.

It will be appreciated that the extension module 8 should itself be rigid and strong because a considerable force is exerted by a player on the extreme end of the racket grip in play and no weakness must result due to the racket shaft itself not extending to the extreme end of the gripping area. The extension module 8 is thus a structural part of the games racket.

Figure 3:
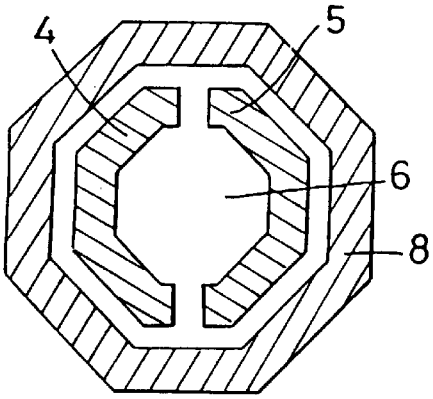
FIG. 3 is a cross-section along A—A of the racket shown in FIG. 2.

FIG. 3 shows in cross-section legs 4,5 and extension module 8 prior to being wedged together by the wedging action.

I claim:

1. A games racket comprises a head and a shaft wherein the shaft consists of two separable components locked rigidly by a wedging action prior to the use of the games racket, the separable components consisting of shaft portions integral with the head and an extension module;

wherein the head and extension module are provided with complementary formations which key in together when the wedging action is applied, said complementary formations consisting of a tongue and slot which key in together as a force fit.

2. A games racket according to claim 1 wherein the wedging action is provided by means of a wedge which forces the shaft portion against the extension module by means of a screw.

3. A games racket according to claim 2 wherein the wedge is situated between the shaft portions which are forced outwardly against a surrounding extension module.

4. A games racket according to claim 3 wherein the shaft portions define wedge profiles.

5. A games racket according to claim 3 wherein the inner surface of the extension module converges towards the head of the racket.

6. A games racket according to claim 3 wherein the shaft portions define a polygonal cross-section and the extension module has a polygonal cross-section matching that defined by the shaft portions.

7. A games racket according to claim 3 wherein the shaft portions constitute a region of the shaft having a reduced width in comparison with a second region of the shaft adjacent the head, and wherein the extension module has a width matching that of said second region, so that the extension module is substantially flush with said second region of the shaft when fitted over the shaft portions.

8. A games racket according to claim 1 wherein the overall length of the racket incorporating an extension module is 27" or more.

9. A games racket according to claim 1 wherein weights are attached to the head of the games racket.

* * * * *